United States Patent [19]

Giarritta

[11] 4,004,690

[45] Jan. 25, 1977

[54] COUPON HOLDER

[75] Inventor: Ninfa R. Giarritta, San Francisco, Calif.

[73] Assignee: Lawrence Peska Associates, Inc., New York, N.Y.

[22] Filed: Aug. 20, 1975

[21] Appl. No.: 606,320

[52] U.S. Cl. ..... 206/425; 150/39

[51] Int. Cl.[2] ..... B65D 85/00

[58] Field of Search ..... 206/425; 150/52 R, 52 B, 150/35, 38, 39, 34, 42, 45

[56] References Cited

UNITED STATES PATENTS

| | | | |
|---|---|---|---|
| 881,078 | 3/1908 | Johnson | 206/425 |
| 1,680,177 | 8/1928 | Schwarz | 150/39 |
| 1,719,358 | 7/1929 | Campbell | 206/425 |
| 3,227,471 | 1/1966 | Coniker | 150/39 |
| 3,367,340 | 2/1968 | David | 150/39 |
| 3,777,795 | 12/1973 | Graetz | 150/39 |
| 3,858,790 | 1/1975 | Humphrey | 150/39 |

FOREIGN PATENTS OR APPLICATIONS

| | | | |
|---|---|---|---|
| 248,379 | 2/1948 | Switzerland | 206/425 |
| 239,544 | 2/1946 | Switzerland | 150/39 |

*Primary Examiner*—Ro E. Hart

[57] ABSTRACT

A coupon holder is disclosed for classifying coupons and presenting coupons readily for manual dispensing comprising a flexible member folded into panels along a vertical line, the panels being on either side of the line. Transparent flexible pockets are placed on the panels in a stepped relation to one another, the pockets also having openings along the vertical edge thereof facing in a direction toward the vertical line that the flexible member is folded on so that when the coupon holder is folded in a closed position, such openings in the pockets are also closed.

10 Claims, 4 Drawing Figures

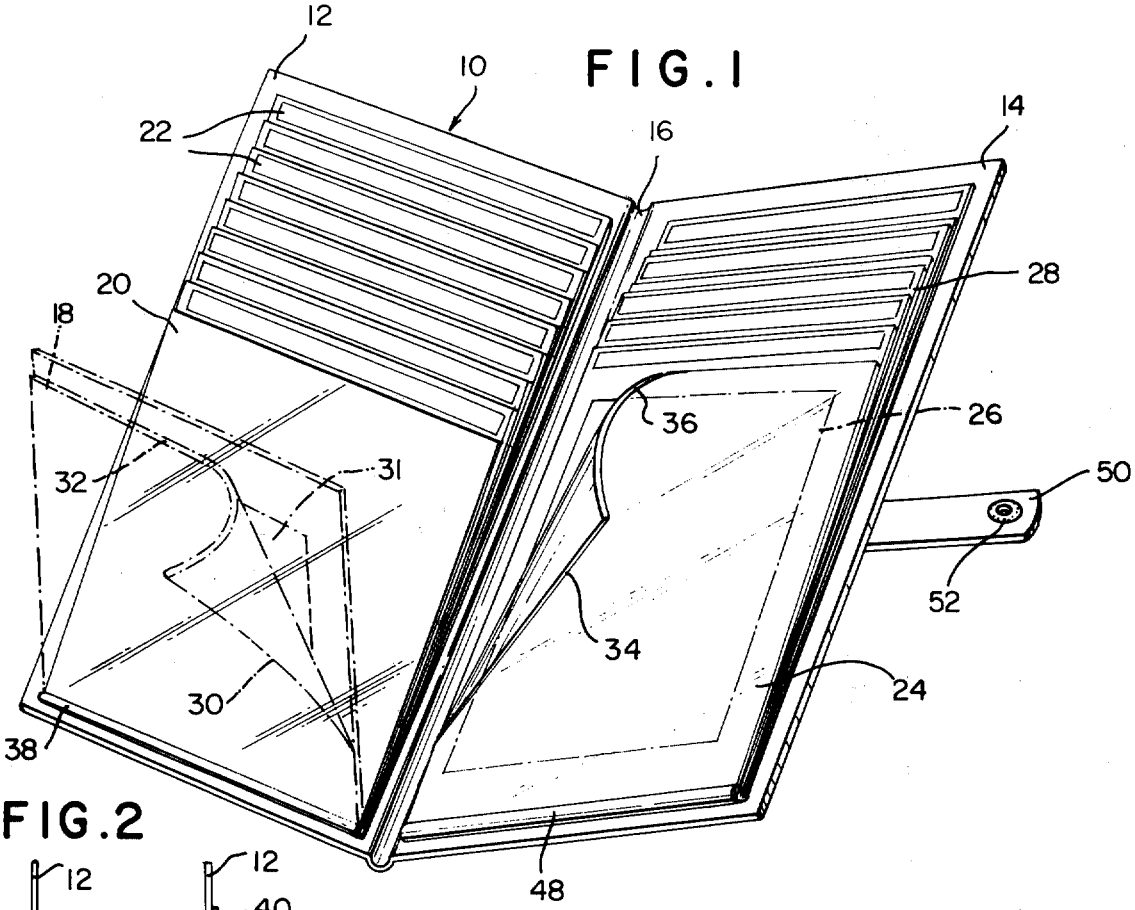
FIG. 1
FIG. 2
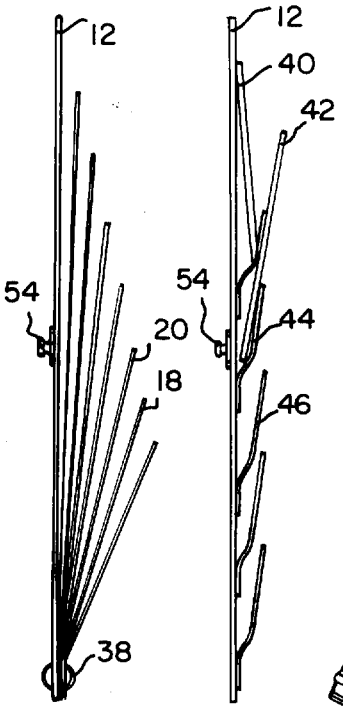
FIG. 3
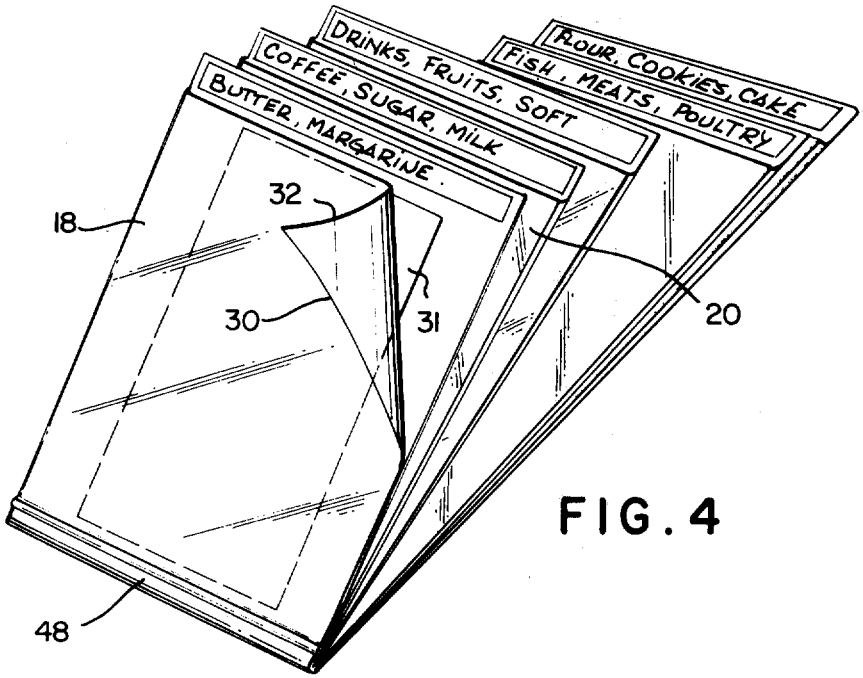
FIG. 4

COUPON HOLDER

SUMMARY OF THE INVENTION

The present invention relates to a novel coupon holder for classifying coupons and for presenting coupons readily for manual dispensing comprising support members that are panel shaped made of a flexible material, said panels being hingedly secured to one another and having transparent pockets hingedly secured to each panel. Openings are provided in each pocket in a manner such that the openings face in a direction substantially toward the edges that are hingedly secured to one another. In one embodiment, a flexible member is folded vertically to form panels on either side of the vertical fold, the vertical fold being a hinge for hingedly securing the panels thus formed to one another. The openings in the pockets that face the vertical line along which the panels are hingedly secured to one another allows such openings to be closed off from access when the panels are folded over on one another in a closed position and the pockets on each of the panels are lying flat against one another.

BRIEF DESCRIPTION OF THE SEVERAL VIEWS OF THE DRAWING

FIG. 1 illustrates a perspective view of the coupon holder according to one embodiment of the present invention.

FIG. 2 is a side elevation of the coupon holder illustrated in FIG. 1.

FIG. 3 is a side elevation of the coupon holder according to one embodiment of the present invention.

FIG. 4 is a perspective view of the pockets employed for holding coupons in the coupon holder according to one embodiment of the present invention.

DETAILED DESCRIPTION

Current marketing practices relative to the merchandising of consumer items include advertising such products in magazines, newspapers and mailers with detachable coupons that may be presented to the retailer to obtain a cash discount when the advertised item is purchased. This type of advertising is especially employed in the sale of food items and other products available in food stores such as soap products housewares and the like. The careful shopper usually takes advantage of these coupon offers as much as possible in order to keep shopping expenses low. Several difficulties have been encountered using these coupon discounts at stores, the least of which is that not every store carries the merchandise for which the coupon can be used thereby requiring the shopper to be able to readily find the coupons that can be turned in for discounts when they are purchasing the discount item. This can be difficult if several coupons have been collected for different items and are carried from store to store until all are cashed in.

It is therefor an object of the present invention to overcome these and other difficulties encountered in the prior art.

It is a further object of the present invention to provide a novel means for classifying, holding and dispensing coupons.

These and other objects have been achieved according to the present invention and will become apparent by reference to the disclosure and claims that follow as well as the attached drawing.

Referring to FIGS. 1 through 4 a coupon holder 10 is illustrated comprising opposable panel support members 12 and 14 which may be constructed of a flexible material such as leather or a thermoplastic composition such as plasticized polyvinyl chloride, polyvinyl chloride copolymers, such as the copolymers thereof with vinyl acetate and the art known equivalents thereof. Panels 12 and 14 are hingedly secured to one another through a vertical hinge which may comprise a fold 16 in the unitary flexible support panels as illustrated in FIG. 1. Transparent pockets such as pockets 18 and 20 and other pockets are hingedly secured to panel 12 whereas similar transparent pockets such as pockets 24 and 28 are hingedly secured to panel 14. Hinges are provided in the bottom of the transparent pockets and comprise, for example, a flexible horizontal member 48 either extending from the transparent pocket or attached thereto. Members 38 and 48 extend horizontally and clampingly secure the lower edge of the pockets to the panels, members 38 and 48 passing through an opening in panels 12 and 14 respectively to clampingly engage the hinge on the bottom of said pockets through the front and back of the panels 12 and 14. The pockets, such as pockets 18, 20, 24, and 28 may also be made of a flexible material such as the flexible thermoplastic material employed in the manufacture of panels 12 and 14.

Each of the pockets such as pockets 18 and 24 have an opening such as opening 30 and 34 respectively which face in a direction substantially toward the fold or hinge 16 so that when the panels 12 and 14 are folded down on one another to close the coupon holder, the pockets on panel 12 will abuttingly engage the pockets on panel 14. These pockets, like the coupon holder will also be closed since the contents thereof such as coupons 31 and 26 can only move toward the centerfold or hinge 16. In a further embodiment an L-shaped opening is provided in the pockets attached to the panels such as pockets 18 and 24 which comprises a horizontal opening 32 transverse to the opening 30 in pocket 18 and similarly a horizontal opening 36 transverse to the opening 34 in pocket 24. The pockets are arranged so that the upper horizontal edges thereof are in a stepped relation to one another making labels 22 readily visible.

In an alternate embodiment, the pockets employed according to the present invention instead of being secured to the panels 12 and 14 through a common clamping member are attached to the panels such as panel 12 by individual securing members comprising pocket receiving members 44 and 46 which extend upwardly as illustrated in FIG. 3 to receive the pockets 40 and 42 individually so that they may be stepped in relation to one another without having to be of successively increasing height as is the case with the embodiment illustrated in FIG. 2.

Coupon holder 10 may be folded over on itself through fold 16 and held in a closed position by flap 50 secured to the outer edge of panel 14, flap 50 having a snap 52 mounted therein for snapingly engaging a snap receiving member 54 mounted on and secured to the outer edge of panel 12.

In use, the coupon holder 10 has labels 22 attached to the upper stepped edges of the pockets thereof such as pockets 18, 20, 24 and 28 to classify coupons that are to be inserted therein. A coupon such as coupon 31 is placed in pocket 18 by folding pocket 18 outwardly to make the openings 30 and 32 more accessible. The edge of opening 30 is pulled backwards to provide a flap to guide the entry of a coupon into pocket 18 and then the coupon holder is closed and snapped secure by pulling flap 50 over the outer edges of the coupon holder and attaching snap 52 to snap receiving member 54. The openings facing fold 16 that can be used to remove the coupons are also effectively sealed when the coupon holder is closed. With a number of coupons in the holder properly classified in the coupon holder, the coupons can be readily found and presented with purchases of the items that coupons apply to.

Although the invention has been described by reference to some embodiments, it is not intended that it be limited thereby, but that certain modifications thereof are intended to be included within the broad spirit and scope of the foregoing disclosure, the following claims and the appended drawing.

What is claimed is:

1. A coupon holder for classifying coupons and for presenting coupons readily for manual dispensing comprising opposable panel support means, said panel means hingedly secured to one another, transparent pocket means hingedly secured to each panel, opening means in said pocket means for inserting and withdrawing coupons from said pocket means, said openings facing in a direction substantially toward the edges of said panels that are hingedly secured to one another.

2. The coupon holder of claim 1 where said panels are hingedly secured to one another at the vertical edges thereof for opening and closing said panels, said opening means comprising an L-shaped opening, the upper edge of said opening extending horizontally along the upper edge of said pocket, the side opening of said pocket extending vertically and transversely to the upper edge of said opening and parallel to the vertical edges of said panels that are hingedly secured to one another whereby when said panels are closed the opening in said pockets on the vertical edge thereof faces inwardly toward said coupon holder to thereby close such openings.

3. The coupon holder of claim 2 where said pocket means comprises a plurality of pockets on said panels, the upper horizontal edges of said pockets being in a stepped relation to one another.

4. The coupon holder of claim 3 where the horizontal edges of said pockets are substantially parallel to one another, the bottom edges of said pockets being hingedly secured to said panel means.

5. The coupon holder of claim 4 where said pockets have hinge means at the bottom horizontal edge thereof for hingedly engaging hinge securing means on said panels, the upper horizontal edge of said pocket having label means for identifying the contents of said coupon holder.

6. The coupon holder of claim 5 where said pockets are held by a single hinge securing means on each of said panels, the upper horizontal edges of said pockets on each of said panels extending upwardly in a stepped relation.

7. The coupon holder of claim 6 where said panels are foldably securable to one another by clasp means and clasp receiving means on the outer vertical edges of said panels.

8. The coupon holder of claim 5 where each of said pockets are held by hinge securing means, the upper horizontal edge of each of said pockets on each of said panels extending upwardly in a stepped relation.

9. The coupon holder of claim 8 where said panels are foldably securable to one another by clasp means and clasp receiving means on the outer vertical edges of said panels.

10. The coupon holder of claim 5 where said panels are foldably securable to one another by clasp means and clasp receiving means on the outer vertical edges of said panels.

* * * * *